US007377999B2

(12) United States Patent
Ahvenniemi et al.

(10) Patent No.: US 7,377,999 B2
(45) Date of Patent: May 27, 2008

(54) ARRANGEMENT IN THE ON-LINE FINISHING OF THE PAPER MACHINE

(75) Inventors: Vesa Ahvenniemi, Helsinki (FI); Jorma Kinnunen, Helsiniki (JP)

(73) Assignee: Metso Paper, Inc., Helsinki (FI)

( * ) Notice: Subject to any disclaimer, the term of this patent is extended or adjusted under 35 U.S.C. 154(b) by 474 days.

(21) Appl. No.: 10/533,333

(22) PCT Filed: Nov. 3, 2003

(86) PCT No.: PCT/FI03/00811

§ 371 (c)(1),
(2), (4) Date: May 2, 2005

(87) PCT Pub. No.: WO2004/042145

PCT Pub. Date: May 21, 2004

(65) Prior Publication Data

US 2006/0102309 A1 May 18, 2006

(30) Foreign Application Priority Data

Nov. 4, 2002 (FI) ..... 20025048

(51) Int. Cl.
*D21F 7/00* (2006.01)
*D21F 5/02* (2006.01)
*D21G 9/00* (2006.01)

(52) U.S. Cl. ..... 162/193; 162/135; 162/194; 162/198; 162/255; 162/263; 162/265; 162/286

(58) Field of Classification Search ..... 162/193, 162/194, 135, 265, 198, 263, 197, 289, 207, 162/255, 286; 226/91, 92; 34/117, 120
See application file for complete search history.

(56) References Cited

U.S. PATENT DOCUMENTS 4,728,396 A * 3/1988 Alheid ..... 162/193
5,517,765 A * 5/1996 Christansen ..... 34/116
5,641,387 A * 6/1997 Baldini ..... 162/265
6,395,135 B1 5/2002 Kojo et al.

(Continued)

FOREIGN PATENT DOCUMENTS

EP 0 274 977 AI 7/1988

(Continued)

OTHER PUBLICATIONS

International Preliminary Examination Report on Patentability issued in PCT/FI2003/000811.

(Continued)

*Primary Examiner*—Eric Hug
(74) *Attorney, Agent, or Firm*—Stiennon & Stiennon

(57) ABSTRACT

An arrangement in the on-line finishing of a paper machine, which includes at least one finishing stage (12, 13) for the paper web produced, has cutting equipment (16) for forming the tail as well as tail threading equipment (15) for carrying the tail through the finishing stage (12, 13). At the end of the finishing stage (12, 13) there is a draw point (24), through which a carrier rope system (17) included in the tail threading equipment (15) is adapted to pass. The draw point (24) is formed between one cylinder (28) and a wire (29) arranged in contact with it for forming a single-contact draw point.

27 Claims, 4 Drawing Sheets

U.S. PATENT DOCUMENTS 6,630,057 B2 * 10/2003 Broom et al. ..... 162/363
2004/0060676 A1 4/2004 Gron et al.

FOREIGN PATENT DOCUMENTS

EP 0 427 887 A1 5/1989
WO 02/38858 A2 5/2002
WO 2000/042144 A1 5/2004
WO 2004/042145 A1 5/2004

OTHER PUBLICATIONS

International Search Report issued in PCT/FI2003/000811.

* cited by examiner

ARRANGEMENT IN THE ON-LINE FINISHING OF THE PAPER MACHINE

CROSS REFERENCES TO RELATED APPLICATIONS

This application is a U.S. national stage application of International app. No. PCT/FI12003/000811, filed Nov. 3, 2003, the disclosure of which is incorporated by reference herein, and which claims priority on Finnish App. No. 20025048, filed Nov. 4, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement in the on-line finishing of a paper machine, which includes at least one finishing stage (12, 13) for the paper web produced with the paper machine, and which arrangement includes

- cutting equipment (16) prior to the finishing stage (12, 13) for forming a tail from a fully wide paper web,
- tail threading equipment (15) for taking the formed tail through the finishing stage (12, 13), and
- a draw point (24) at the end of the finishing stage (12, 13) for tensioning and holding the paper web in the finishing stage (12, 13), with the carrier rope system (17) included in the said tail threading equipment (15) being adapted to pass by the draw point (24).

Today in paper machines, the tendency is to locate the finishing line immediately after the production line in order to improve efficiency. This means that the paper web is immediately guided to the finishing process from the last section of the production line without intermediate reeling and a separately located finishing line. In other words, the paper web runs at the production speed during finishing, and therefore the term on-line finishing is also used. Normally finishing includes coating of the paper. To produce an optimum quality paper, the paper web is first precalendered in the finishing process in order to ensure successful coating. Finally the coated paper is often also calendered, which provides a good surface smoothness and gloss, for example, to the coated paper.

The paper web is taken through the various finishing stages by means of a tail formed out of the paper web. The tail also proceeds at the production speed. Consequently, particularly the speed differences between the various tail threading devices often cause a tail threading failure. In addition, the paper web is spread to the full width between the different finishing stages prior to starting the following tail threading procedure. In present applications the tail must be taken, for example, through the coating process and spread to the full width before the paper web can be measured in respect of precalendering. Consequently, controlling of the various finishing stages is indefinite and awkward because the reliability of the effect of the various finishing stages is uncertain. Furthermore, in the situation described above, the coated paper needs to be guided to broke treatment during the precalendering adjustment. This increases the consumption of the coating material and complicates the broke treatment.

Adjustment problems are also created in tail threading because the tail needs to be guided for a long distance. This makes the tail stretch and even break sometimes Also the speed differences between the various tail threading devices and finishing devices lead to tail breaking, in which case the tail threading procedure must be usually started over again. Particularly in the present paper machines the tail threading devices are provided with speed sensors. In practice, however, controlling the speed of the tail threading devices and a sufficiently accurate speed measurement are difficult and sometimes even impossible. With the further increasing speed, the problems become even worse. Normally the tail is transferred through the finishing stage by means of ropes. The finishing stage often ends at a drying unit, which comprises dryer cylinders and a dryer wire. When arriving at the drying unit with the carrier rope system, the tail tends to move onto the dryer wire if even a slight speed difference is present. In this situation the tail normally breaks and tail threading fails. At the same time, parts of the tail remain in the drying unit, which may disturb the following tail threading attempts.

The tail is usually formed out of the paper web using water cutters, which are arranged in connection with the drying units. As the paper web must be cut against the dryer wire, cuttings gradually block the dryer wire. Cuttings also spread into the drying unit and, in the worst case, to the entire finishing process following it. This increases the likelihood of web breaks and impairs the quality of the final product.

Furthermore, various kinds of cleaning devices are required.

U.S. Pat. No. 4,728,396 sets forth a coater and a method for using it. In this method the web is guided to the broke pit at the full web width after unreeling the paper reel. A tail is separated from the web, and this tail is guided to the coating device. After spreading the tail, coating is started. At a web break, the web is led to the broke pit at the processing speed and the tail threading procedure is repeated. The equipment in question is a so-called off-machine coater. In addition, there is low potential in contributing to a successful tail threading.

SUMMARY OF THE INVENTION

The object of the invention is to provide a novel arrangement for the on-line finishing in the paper machine, which avoids both tail breaks and unnecessary soiling of the finishing processes. In the arrangement according to the invention a draw point with a single contact is used. In addition, with the arrangement according to the invention, the tail can be kept under a better control than heretofore. At the same time, the likelihood of a successful tail threading is higher than before. In addition, the arrangement according to the invention is grouped better than earlier and its discontinuation points are as few as possible. The arrangement also allows to cut the paper web without soiling the finishing stage. At the same time, broke treatment can be easily arranged at the end of the finishing stage. In addition, each finishing stage is separately used. This enables an optimum control of each finishing stage minimizing the production breaks. Correspondingly, the final result of each finishing stage can be determined prior to moving to the following finishing stage. This facilitates the control of the paper machine and reduces the amount of broke.

The invention is described below in detail by making reference to the enclosed drawings, which illustrate some of the embodiments of the invention.

DESCRIPTION OF THE PREFERRED EMBODIMENTS

Figure 1:
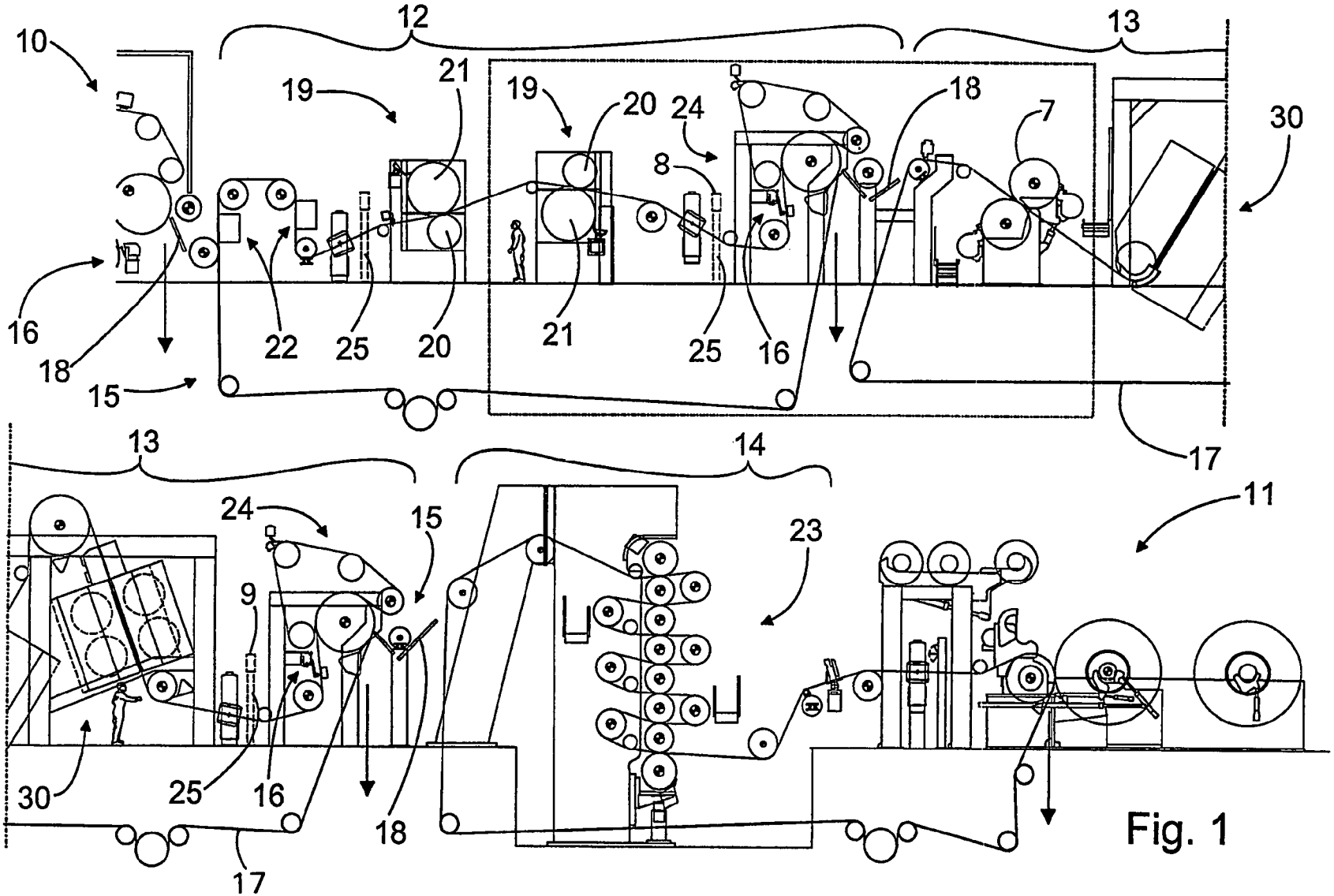
FIG. 1 shows a skeleton drawing of the arrangement according to the invention.

FIG. 1 is a skeleton drawing of the arrangement according to the invention, which is specifically intended for the on-line finishing in the paper machine. In FIG. 1 the actual production stages of the paper machine end at the dryer section 10, from which the paper web produced with the paper machine is run down to broke treatment. Similar points, at which the paper web is run down, are illustrated in the drawings with downward pointing arrows. Broke treatment equipment is not shown in the drawings. At the end of the finishing process, the paper web is reeled up with the reel 11. Prior to reeling the finishing process includes the successive finishing stages of at least precalendering 12 and coating 13. Here coating 13 is additionally followed by calendering 14. The finishing stages 12-14 also include the tail threading equipment 15 for taking the tail through the finishing stages 12-14. To form the tail out of the fully wide paper web, the tail threading equipment 15 also includes cutting equipment 16. Here the tail threading equipment 15 mainly consists of carrier rope systems 17, which are used to carry the tail onwards. The tail threading equipment 15 also comprises, mainly between the various finishing stages, vacuum belt conveyors 18, which are used to transfer the tail, formed out of the paper to be run down, to the tail threading equipment of the following finishing stage—in this case to a carrier rope system. For clarity, neither the paper web nor the tail is shown in the figures. In each finishing stage the carrier rope systems essentially pass over the same route as the paper web does in the production.

In the application displayed precalendering 12 consists of two successive so-called soft calenders 19. Their calendering nips are composed of a hard roll 20 and a softer counter roll 21. In the successive soft calenders 19 the softer counter roll 21 is alternately on the different sides of the paper web, thus precalendering the two sides of the paper web in turn. Prior to the soft calenders 19, on both sides, there is additionally moistening equipment 22, which can be used to adjust the moisture profile of the paper web when required. Coating also takes place in the nip, which is followed by the drying equipment 30. Finally, there is a so-called hard calender 23, composed of several rolls placed on top of each other between which several nips are formed. From the hard calender 23 the coated and calendered paper web is led to the reel 11, which shares a carrier rope system with the hard calender 23. The equipment used in various finishing stages can vary between different applications. The same reference numbers are used for functionally similar parts.

According to the invention, at the end of each finishing stage there is a draw point forming one contact for tensioning and holding the paper web in the finishing stage concerned. The draw point is generally referred to with the number 24. Due to the draw point, the paper web is kept under control for the entire duration of the finishing stage. A single contact of the draw point is particularly important as regards the tail. In practice, the draw point terminates the finishing stage and the carrier rope system used as the tail threading device is guided through it. Due to the single contact, the speed difference between the tail threading device and the draw point, as well as a possible tail break caused by it, have no importance, because the tail is run down to broke treatment immediately after the draw point. In other words, it may be even desirable that the tail is transferred to the draw point from the tail threading device, the tail thus being immediately under control. Consequently, also the paper web can be spread earlier than before, which shortens the production break.

The arrangement preferably also includes measuring elements 25 arranged in the finishing stage 12-14 prior to the draw point 24 for determining the desired properties of the paper web. The purpose of the measuring elements is discussed in more detail in connection with the description of the operation of the arrangement according to the invention.

Figure 2A:
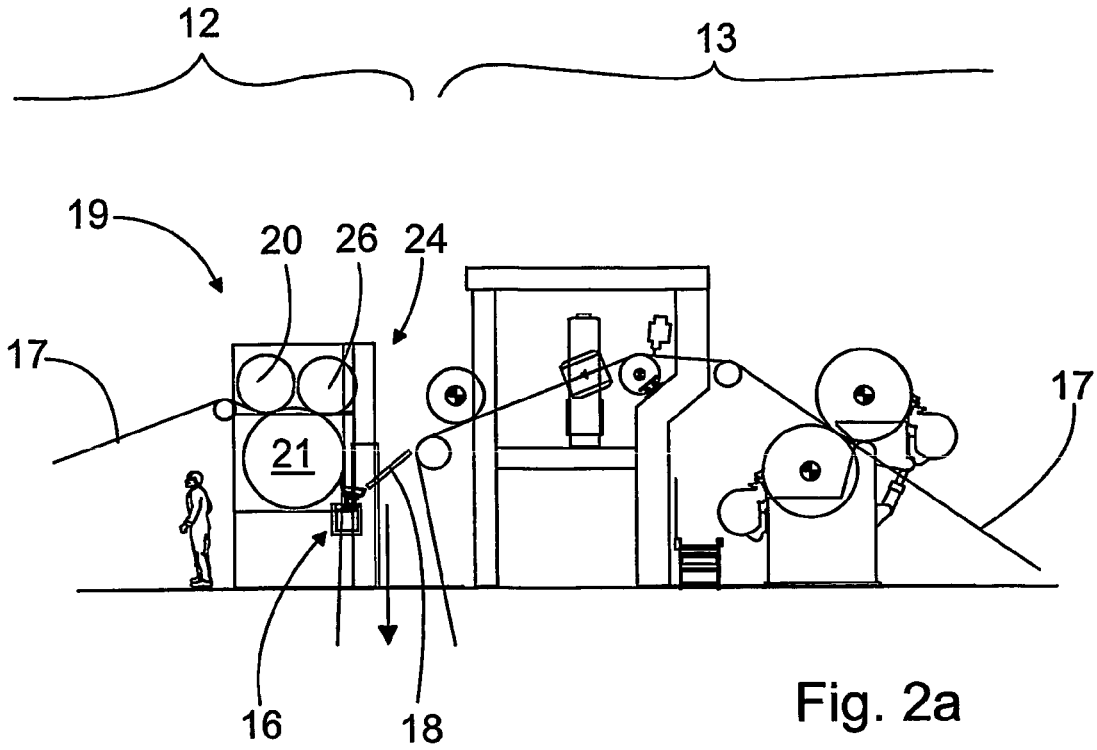
FIG. 2*a* shows a variation of one finishing stage of the arrangement illustrated in FIG. 1.
Figure 2B:
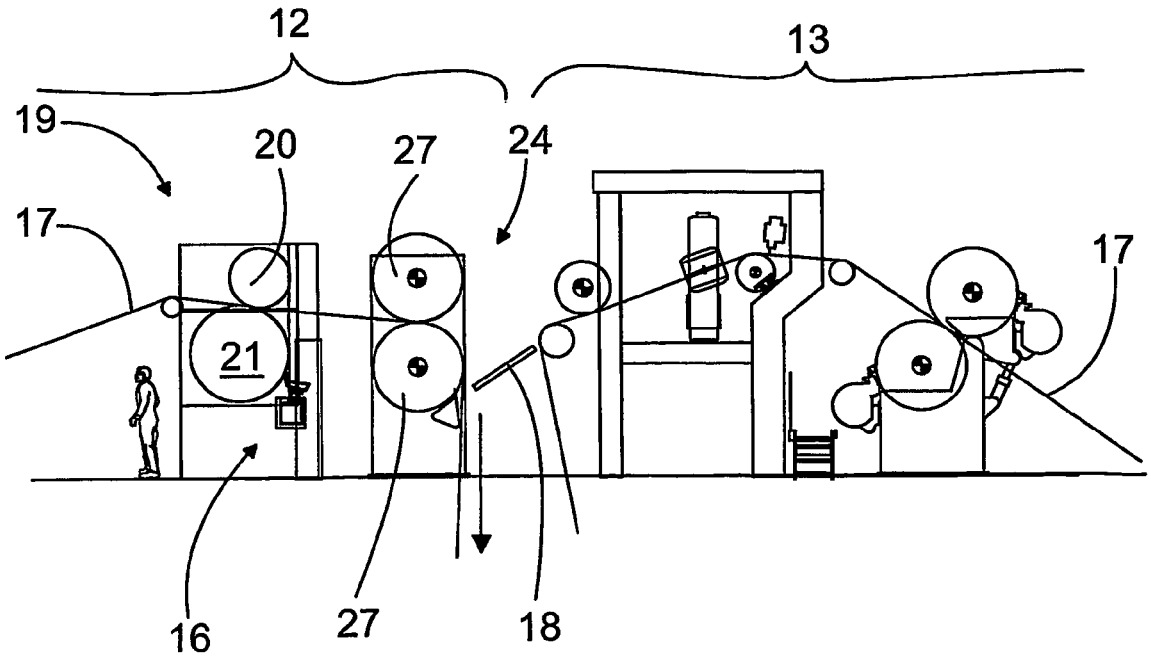
FIG. 2*b* shows another variation of one finishing stage of the arrangement illustrated in FIG. 1.

FIG. 1 shows the arrangement according to the invention, in which both the draw point 24 placed after precalendering 12 and the one after coating 13 are similar. FIGS. 2*a* and 2*b* show variations of the draw point after precalendering. The point in question is circled with a dot-and-dash line in FIG. 1. Generally the draw point forming a single contact is arranged as a roll nip or a fabric transfer between two rolls. In FIG. 2*a* one roll in the roll nip is a counter roll 21 adapted for precalendering 12, while the other one is a separate auxiliary roll 26. This ensures that the total length of the finishing stage remains as short as possible. On the other hand, an extra auxiliary roll complicates the design of the precalender and hinders its guiding especially in tail threading. FIG. 2*b* illustrates a third application of the draw point 24, in which both the rolls of the roll nip are auxiliary rolls 27. The auxiliary rolls 27 are additionally arranged separately from the equipment included in the finishing stage. In this case, precalendering remains unchanged, but an extra pair of rolls increases the length of the finishing stage. In both the applications set forth above the problem is additionally the distance between the cutting equipment and the following finishing stage, i.e. coating here. Furthermore, drying of the paper web is impossible. On the other hand, in the application of FIG. 2*b* the cutting equipment 16 could also be located within the open draw of the paper web.

Figure 3:
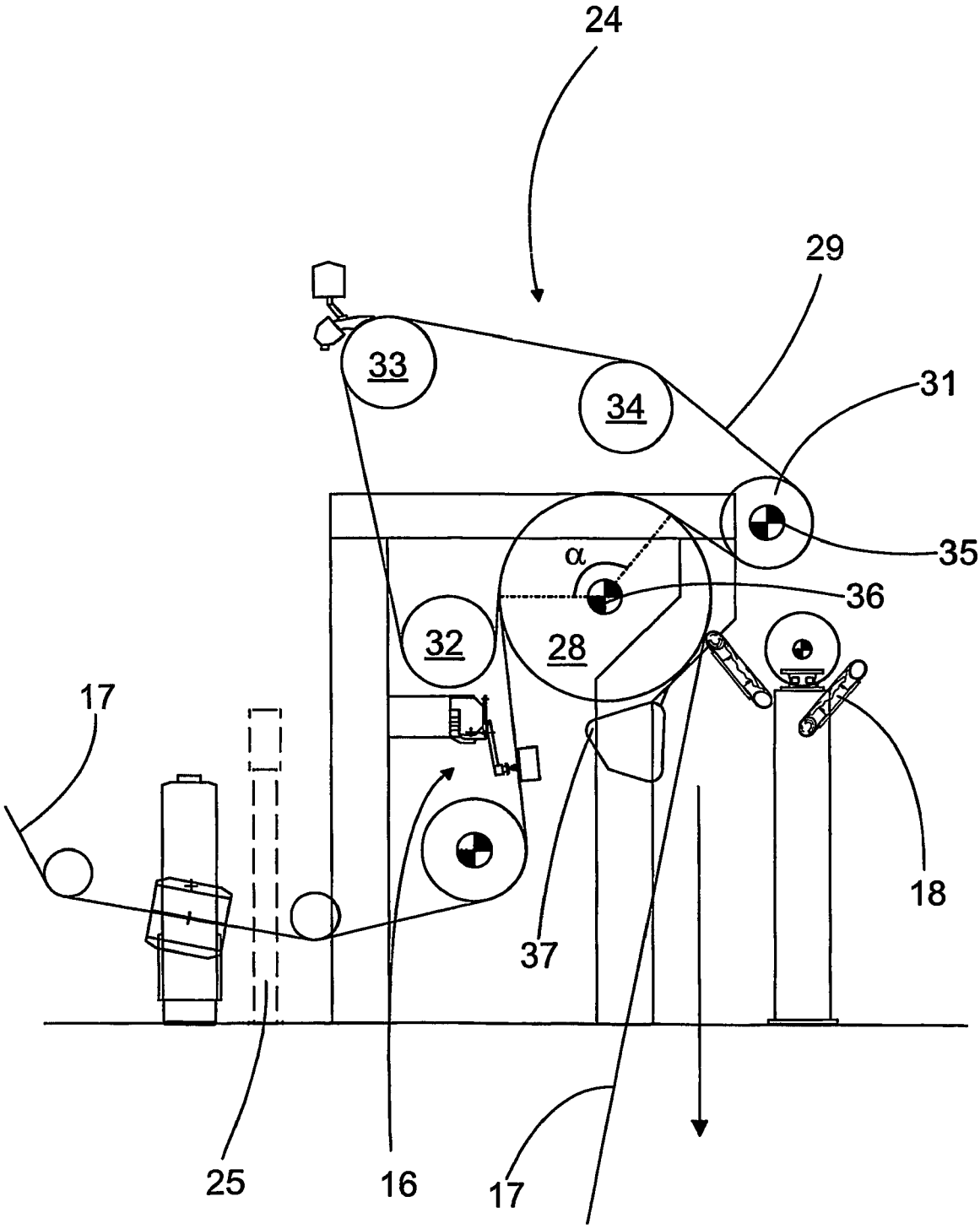
FIG. 3 is an enlarged view of a part of the whole of the arrangement according to the invention.

Both of these problems are avoided with the draw points 24 illustrated in FIGS. 1 and 3, in which the fabric transfer is formed between one dryer cylinder 28 and a dryer wire 29 arranged to contact it. In this way, a drying effect is provided to the paper web at the draw point and the paper web can be simultaneously drawn more efficiently than before. The tail is also reliably transferred to the influence area of the dryer wire so that the tail can be quickly taken under control before it is run down to broke treatment. In this application, too, the speed difference between the dryer wire and the carrier rope system has no significance, yet, in practice, it is attempted to keep it as small as possible. The solution also provides an advantageous tail formation. The only drawback is mainly the increased length of the finishing stage. On the other hand, a single-cylinder draw point is remarkably shorter than the known three-cylinder drying equipment.

Furthermore, in the embodiment set forth, the paper web can be dried also after precalendering.

FIG. 3 illustrates in more detail a one-cylinder application, in which the draw point is formed between one cylinder 28 and a wire 29 arranged in contact with it. By arranging the cylinder as a dryer cylinder and the wire as a dryer wire, a drying effect can be provided to the paper web. In practice, the overpressure applied inside the dryer cylinder is 0.5-1.0 bar. Even a small wrap angle of the dryer wire 29 provides a reliable tail seizure and an efficient paper web draw. Generally the wrap angle $\alpha$ in the cylinder periphery created by the wire a is 100°-160°. According to the invention the cutting equipment 16 is adapted to cut the tail from the paper web within its open draw. This becomes evident specifically in FIG. 3. Here the cutting equipment 16 is composed of water cutters, which are arranged prior to the actual draw point. This prevents access of cuttings to the production process or onto the dryer wire, and it is easy to guide away the cuttings from the cutting point in a controlled way. In addition, the cutting equipment is placed advantageously near to the run-down position, which minimizes disturbances in tail threading and spreading of cuttings to the process.

The drive 35 included in the draw point 24 according to the invention is arranged in connection with a lead roll 31 adapted to support the wire 29. In this way the tail and the paper web are drawn by the wire avoiding thus the speed difference between the cylinder and the paper web. This drive is also called the main drive. In addition, the friction between the wire and the paper web is remarkably better than that between the cylinder and the paper web. In addition to the lead roll 31, the wire 29 arranged as an endless loop is supported by three other rolls 32-34. This provides a sufficient wire wrap angle and good draw properties for the driven lead roll. In addition, wire conditioning is efficient. Furthermore, in connection with the cylinder 28 included at the draw point 24 there is arranged an auxiliary drive 36, which is adapted to follow the drive 35 of the lead roll 31. In this way, the dryer cylinder can be quickly accelerated to the production speed especially at the startups. The drives are usually electric motors. In connection with the cylinder 28 there is additionally arranged a doctor 37, which is used to detach the paper web from the cylinder 28 surface and to guide it down to broke treatment. At the same time, the doctor keeps the cylinder surface clean.

Normally the paper web is spread to the full width after tail threading prior to forming and taking the following tail to the following finishing stage. According to the invention, prior to starting the tail threading procedure of the next finishing stage and forming the tail, the finishing stage in question is surprisingly set to the production settings while the paper web is spread in its full width. This facilitates the total control of the finishing stages. A reliable broke treatment is provided with the above described draw point, which is used to tension and hold the paper web in the finishing stage. This also ensures that the tension of the paper web is always appropriate particularly when using a single-cylinder draw point.

Draw points placed at the ends of the finishing stages also enable the determination of the paper web properties in each finishing stage already prior to starting the next tail threading. These properties are determined at the draw point and/or prior to it. To achieve this, the arrangement includes measuring elements 25 known as such, which are used to determine for example the moisture content of the paper web as well as porosity, gloss and other surface properties. A controller 8 is arranged in data receiving relation to the measuring elements 25 forming part of the precalendering finishing stage 12, and the controller 8 is in controlling relation to the precalender 19. Similarly a controller 9 is arranged in data receiving relation to the measuring elements 25 forming part of the coating finishing stage 13. The controller 9 is in controlling relation to the coater 7. Based on the specified paper properties each finishing stage is then easy to adjust to the production settings. In this way, considering the whole, the control of the finishing stages is less complicated with a smaller broke amount and coating-material consumption than heretofore.

Figure 4A:
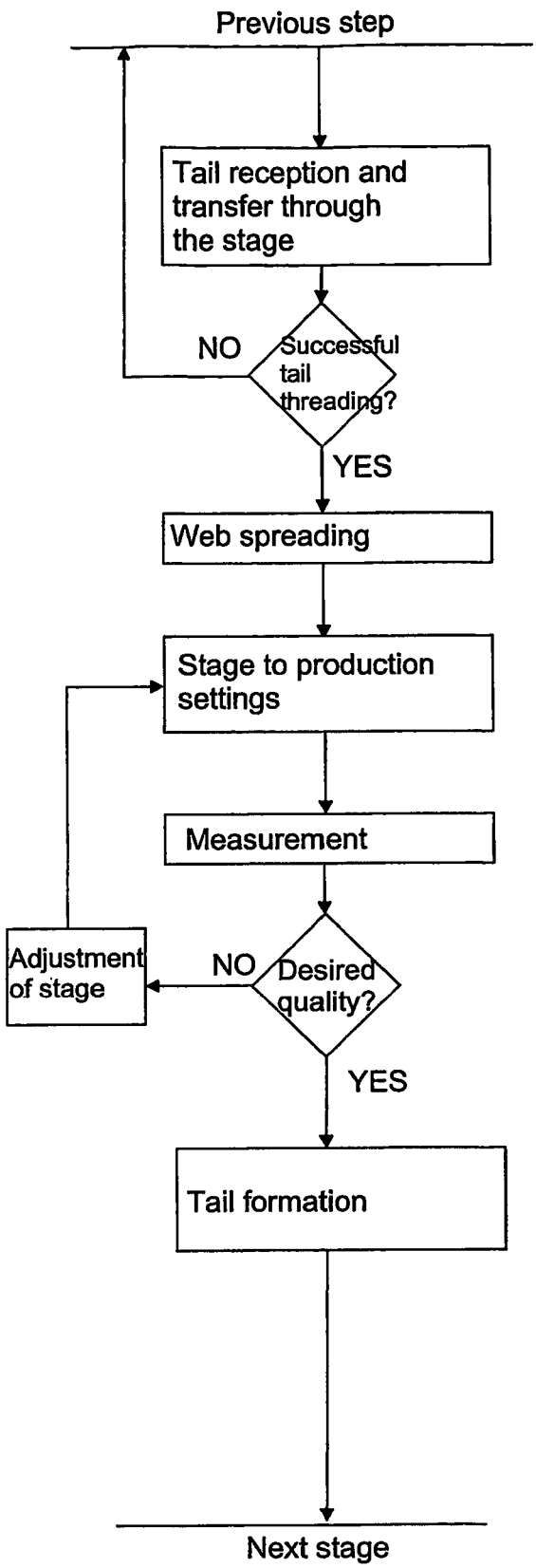
FIG. 4*a* is a flow chart, covering one finishing stage, illustrating the operation of the arrangement according to the invention.

Adjustments of the finishing stages particularly influence the properties of the paper web and the final product made of it. Furthermore, according to the invention, the properties of the tail in the tail formation are changed. This ensures a successful tail threading. In practice, the moisture content of the tail is changed using for example special moistening nozzles. FIG. 4*a* shows a flow chart in which the operation of the arrangement according to the invention is illustrated for one finishing stage, simplified for one stage. The stage starts with the reception of the tail formed in the previous stage. The tail threading procedure is repeated until it is successful, after which the paper web is spread to the full width. The tail transferred through the stage is run down to broke treatment at the end of the stage. According to the invention, the stage is thus set to the production settings after spreading and the treated paper web is measured. The determination of the quality of the paper web takes place based on these measurements. In case there are deviations in the quality, the stage will be adjusted. Once the desired paper web quality is achieved, a tail is formed and guided to the following stage.

Figure 4B:
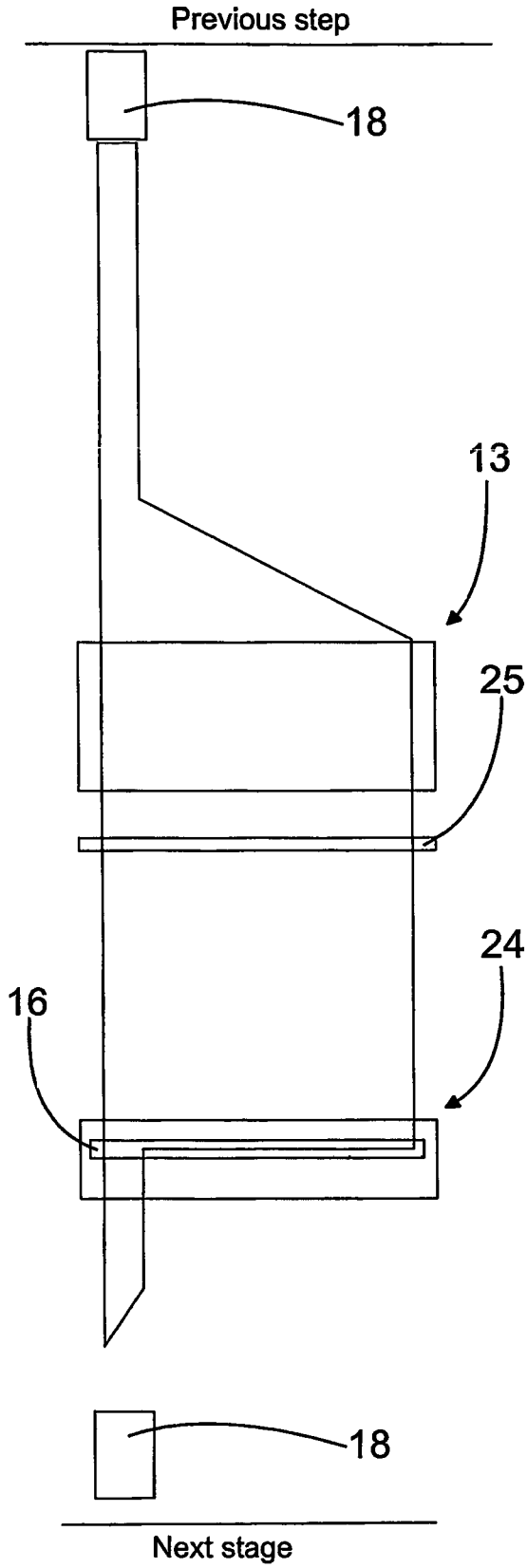
FIG. 4*b* is a skeleton drawing illustrating the travel of the paper web in one finishing stage of the arrangement according to the invention.

FIG. 4*b* shows the travel of the paper web in a stage, which is here coating 13. The use of the measuring elements 25 is possible at the draw point 24 according to the invention, which keeps the paper web under control at all times. Here the paper web has passed the stage and has already been spread to the full width. In practice, this spreading takes place in the previous stage. In the situation illustrated in FIG. 4*b*, the cutting equipment 16 is used to form a tail from the paper web whose quality has been proven good. The rest of the paper web is then run down to broke treatment after the draw point 24. Between the stages the tail is transferred using for example vacuum belt conveyors 18.

In the arrangement according to the invention, the various tail threading procedures are separate and distinct entities, corresponding to the different finishing stages. Each tail threading procedure includes few disturbance points and the tail is kept under control at all times. Due to the draw point according to the invention, the speed difference between the various tail threading devices and the draw point has no importance. Due to the draw point, the properties of the paper web can be determined in each finishing stage prior to the following finishing stage. In this way, by means of the arrangement according to the invention, the production process can be appropriately adjusted in a simple and accurate manner. This saves both time and energy. At the same time, the finishing stage is kept clean, which reduces the need for cleaning equipment. With the arrangement according to the invention it is possible to optimize each finishing stage and hence also the paper properties prior to starting the following tail threading. In practice, precalendering and coating can be optimized prior to the start of the actual calendering, which also makes the entire finishing process remarkably more stable than heretofore.

The invention claimed is:

1. A paper machine incorporating on line finishing, and defining an upstream direction and a downstream direction wherein a paper web formed on the paper machine is arranged to travel in the downstream direction, comprising:

at least one finishing stage arranged within the paper machine for finishing a paper web produced on the paper machine, the at least one finishing stage having a downstream end;

cutting equipment arranged within the finishing stage, the cutting equipment arranged to form a tail from a full width paper web;

tail threading equipment extending from the cutting equipment through the at least one finishing stage, and a single-contact draw point formed of only a single dryer cylinder and a single drying wire wrapping an upper portion of the single dryer cylinder, the single drying cylinder and single drying wire forming a path to broke treatment after the single drying wire leaves the single dryer cylinder, the single-contact draw point arranged to tension and hold a paper web, the single-contact draw point arranged at the downstream end of the finishing stage and downstream of the cutting equipment.

2. The paper machine of claim 1 wherein the cutting equipment is composed of water cutters that are positioned over an open draw in the paper machine.

3. The paper machine of claim 1, wherein a wrap angle of 100°-160° is defined by the wire on the periphery of the cylinder.

4. The paper machine of claim 1, wherein the tail threading equipment includes a carrier rope system passing through the single-contact draw point and wherein in addition to the carrier rope system the tail threading equipment includes at least one vacuum belt.

5. The paper machine of claim 1, wherein the cylinder is a dryer cylinder.

6. The paper machine of claim 1, wherein the wire is a dryer wire.

7. The paper machine of claim 1, wherein the wire is supported and driven by a lead roll connected to a drive.

8. The paper machine of claim 7, wherein, in addition to the lead roll, the wire forming an endless loop is supported with three additional rolls.

9. The paper machine of claim 7, wherein the cylinder has an auxiliary drive, which is arranged to follow the drive of the lead roll.

10. A paper machine incorporating on line finishing, and defining an upstream direction and a downstream direction wherein a paper web formed on the paper machine is arranged to travel in the downstream direction, comprising:

at least one finishing stage arranged within the paper machine for finishing a paper web produced on the paper machine, the at least one finishing stage having a downstream end;

cutting equipment arranged within the finishing stage, the cutting equipment arranged to form a tail from a full width paper web;

tail threading equipment extending from the cutting equipment through the at least one finishing stage, and a single-contact draw point formed between one cylinder and a wire arranged in contact with the one cylinder, the single-contact draw point arranged at the downstream end of the finishing stage and downstream of the cutting equipment;

wherein the tail threading equipment includes a carrier rope system passing through the single-contact draw point;

wherein the at least one finishing stage has equipment changing selected properties of the paper a selected amount, positioned upstream of the single-contact draw point and further comprises:

measuring elements forming part of the finishing stage positioned upstream of the single-contact draw point and downstream of the equipment changing the properties of the paper a selected amount, the measuring elements arranged for measuring the selected properties of the paper.

11. A paper machine having a dryer section and incorporating on line finishing, the paper machine defining an upstream direction and a downstream direction, wherein a paper web formed on the paper machine is arranged to travel in the downstream direction, comprising:

at least one finishing stage forming part of the paper machine downstream of the dryer section for finishing the paper web produced on the paper machine, the at least one finishing stage having a downstream end;

cutting equipment arranged within the finishing stage, the cutting equipment arranged to form a tail from a full width paper web;

a single-contact draw point formed between one cylinder and a wire arranged in contact with the one cylinder, the single-contact draw point arranged at the downstream end of the finishing stage and downstream of the cutting equipment;

tail threading equipment extending from the cutting equipment to a carrier rope system passing through the single-contact draw point;

wherein the at least one finishing stage has equipment for changing selected properties of the paper a selected amount, the equipment positioned upstream of the single-contact draw point, the paper machine further comprising:

measuring elements forming part of the finishing stage positioned upstream of the single-contact draw point and downstream of the equipment changing the properties of the paper a selected amount, the measuring elements arranged for measuring the selected properties of the paper;

a controller in data receiving relation to the measuring elements, and in controlling relation to the equipment changing the selected properties of the paper a selected amount; and wherein the first finishing stage is arranged so that the equipment changing the properties of the paper a selected amount can be adjusted to selected production settings while running a full width web.

12. The paper machine of claim 11, wherein in addition to the carrier rope system the tail threading equipment includes at least one vacuum belt.

13. The paper machine of claim 11, wherein the cylinder is a dryer cylinder.

14. The paper machine of claim 11, wherein the wire is a dryer wire.

15. The paper machine of claim 11, wherein the wire is supported and driven by a lead roll connected to a drive.

16. The paper machine of claim 15, wherein, in addition to the lead roll, the wire forming an endless loop is supported with three additional rolls.

17. The paper machine of claim 15, wherein the cylinder has an auxiliary drive, which is arranged to follow the drive of the lead roll.

18. The paper machine of claim 11, wherein a wrap angle of 100°-160° is defined by the wire on the periphery of the cylinder.

19. A paper machine incorporating on line finishing, comprising:

a paper machine having a dryer section;

a first finishing stage, positioned after the dryer section, the first finishing stage comprising: a precalender followed by a first cutting equipment positioned within a first open draw leading in to a first draw point, the first draw point comprising: only a single dryer cylinder and a single drying wire wrapping an upper portion of the single dryer cylinder, the single drying cylinder and single drying wire forming a path to broke treatment after the single drying wire leaves the single dryer cylinder, the first draw point arranged to tension and hold a paper web;

wherein the first finishing stage is arranged so that the precalender can be adjusted to selected production settings while running a full width web; and a second finishing stage positioned after the first finishing stage, the second finishing stage comprising: a coater followed by a second cutting equipment positioned within a second open draw leading in to a second draw point, the second draw point comprising: only a single dryer cylinder and a single drying wire wrapping an upper portion of the single dryer cylinder, the single drying cylinder and single drying wire forming a path to broke treatment after the single drying wire leaves the single dryer cylinder, the second draw point arranged to tension and hold a paper web in the second finishing stage;

wherein the second finishing stage is arranged so that the coater can be adjusted to selected production settings while running a full with web.

20. The apparatus of claim 19, wherein the first cutting equipment is a water cutter.

21. The apparatus of claim 19, wherein the second cutting equipment is a water cutter.

22. The apparatus of claim 19 further comprising, in the first finishing stage, prior to the draw point, and after the precalender, a plurality of measuring elements, of the type which measure at least one specific paper property and are arranged to measure a paper web before the first draw point; and prior to the second draw point, a plurality of measuring elements, of the type which measure at least one specific paper property and are arranged to measure a paper web before the second draw point.

23. A method of on-line finishing in a paper machine, comprising the steps of:

after a drying section which ends actual production of a paper web on the paper machine, forming a first tail from the paper web and threading the first tail through a precalender in a first finishing stage, the first finishing stage tensioning and holding the paper web with a first draw point formed between a single dryer roll and a single drying wire which holds the paper web between the single dryer wire and the single dryer roll which is the only drawing point between the pre-calendar and a broke treatment immediately after the first draw point;

spreading the first tail to a full width web in the precalender;

precalendering the paper web in the precalender;

determining selected paper web properties at or prior to the first draw point;

setting the precalender to production settings based on the determined paper web properties;

in the first finishing stage, until the precalender is set to the production settings, guiding the paper web to the broke treatment immediately after the first draw point;

following setting the precalender to production settings, forming a second tail from the paper web in an open draw leading into the first drawing point and threading the second tail through a coater in a second finishing stage, the second finishing stage tensioning and holding the paper web with a second draw point formed between a single dryer roll and a single drying wire which holds the paper web between the single dryer wire and the single dryer roll which is the only draw point between the coater and a broke treatment immediately after the second draw point;

spreading the second tail to a full width web in the coater;

coating the paper web in the coater to form a coated paper web;

determining selected coated paper web properties at or prior to the second draw point;

setting the coater to production settings based on the determined coated paper web properties;

in the second finishing stage, until the coater is set to the production settings, guiding the coated paper web to the broke treatment immediately after the second draw point; and reeling the coated paper web.

24. The method of claim 23, further comprising the steps of:

following setting the coater to production settings, and before reeling the paper web, forming a third tail from the paper web and threading the third tail through a calender, forming a third finishing stage end;

spreading the third tail to a full width web in the calender;

calendering the paper web in the calender; and setting the calender to production settings, followed by the step of reeling the paper web.

25. The method of claim 23, further comprising the step of changing properties of at least one of the first tail and the second tail, while forming said first tail and said second tail, so as to ensure successful threading of at least one of the first tail and the second tail.

26. A paper machine incorporating on line finishing, comprising:

after a dryer section a precalendering finishing stage, having a precalender;

after the precalendering finishing stage a coating finishing stage, having a coater;

after the coating finishing stage a reeling stage;

wherein the precalendering finishing stage and the coating finishing stage each has a draw point having only a single dryer cylinder wrapped by only a single drying wire, which is arranged to draw a paper web through each finishing stage;

wherein each draw point defines an open draw leading in to the draw point and a point leading to broke treatment equipment;

a cutting equipment positioned within each open draw for forming a tail from a fully wide paper web.

27. The paper machine of claim 26 further comprising measuring elements, of the type which measure at least one specific paper property and are arranged to measure a paper web before each draw point, and after the precalender or the coater.

* * * * *